US006863039B2

(12) United States Patent
Salameh

(10) Patent No.: US 6,863,039 B2
(45) Date of Patent: Mar. 8, 2005

(54) CASING COVER HAVING A DEVICE FOR ASSURING SEALING FORCES

(75) Inventor: Ralf Salameh, Bretten (DE)

(73) Assignee: Federal-Mogul Sealing Systems Bretten GmbH & Co. KG, Bretten (DE)

( * ) Notice: Subject to any disclaimer, the term of this patent is extended or adjusted under 35 U.S.C. 154(b) by 192 days.

(21) Appl. No.: 10/227,451

(22) Filed: Aug. 26, 2002

(65) Prior Publication Data

US 2003/0037743 A1 Feb. 27, 2003

(30) Foreign Application Priority Data

Aug. 24, 2001 (DE) ..... 101 41 570

(51) Int. Cl.[7] ..... F01M 9/10

(52) U.S. Cl. ..... 123/90.38; 123/90.37; 123/195 C; 123/198 E; 277/313; 277/591

(58) Field of Search ..... 123/90.37, 90.38, 123/195 R, 195 C, 198 E, 90.33; 277/313, 316, 591, 598, 915

(56) References Cited

U.S. PATENT DOCUMENTS 4,164,927 A * 8/1979 Congram et al. ..... 123/195 C
6,691,667 B2 * 2/2004 Salameh ..... 123/195 C

FOREIGN PATENT DOCUMENTS

| | | |
|---|---|---|
| DE | 197 38 275 A1 | 3/1999 |
| EP | 0 664 388 A1 | 7/1995 |
| EP | 0 942 155 A1 | 9/1999 |
| EP | 0 942 155 B1 | 5/2003 |

OTHER PUBLICATIONS

Japanese Patent Abstract 59 101 586, Jun. 12, 1984, Shigeru, "Mounting Construction of Oil Pan in Engine".

* cited by examiner

*Primary Examiner*—Thomas Denion
*Assistant Examiner*—Kyle M. Riddle
(74) *Attorney, Agent, or Firm*—Venable LLP; Stuart I. Smith

(57) ABSTRACT

A casing cover (1, 10, 20) for an internal-combustion engine, particularly valve covers or oil pans, for being mounted detachably and fluid-tight to the engine block (5, 13, 21), having a peripheral edge that is profiled to receive an elastomer seal (3, 12) at the edge (2, 11) of the casing cover (1, 10, 20). The cover is provided with an axial extension (7, 14) that is oriented in the direction of the engine block (5, 13, 21) and is disposed at an inner portion of the edge (2, 11) of the casing cover (1, 10, 20). The extension is positioned to project axially beyond the sealing surface (4, 15), an engine block wherein the casing cover is inserted so the casing cover is at least positioned correctly on the engine block.

10 Claims, 1 Drawing Sheet

CASING COVER HAVING A DEVICE FOR ASSURING SEALING FORCES

CROSS-REFERENCE TO RELATED APPLICATION

This application is related to concurrently filed U.S. patent application Ser. No. 10/227,286 corresponding to German Patent Application No. DE 101 41 569, filed Aug. 24, 2002, which is incorporated herein by reference.

This application is based on and claims the priority date of German Application No. 101 41 570.2, filed on Aug. 24, 2001, which is incorporated herein by reference.

BACKGROUND OF THE INVENTION

The invention describes a casing cover for an internal-combustion engine, particularly valve covers or oil pans, to be mounted detachably and fluid-tight to an engine block, with an elastomer seal at the edge of the casing cover, Within the scope of complex assembly strategies in the automobile industry, it is the current practice to provide engine parts with features that facilitate assembly or allow joining devices to he eliminated altogether. In addition to these assembly aids, characteristics that influence the function of the components are integrated into the engine components.

The components addressed in particular here are casing covers, such as valve covers or oil pans, which are completely assembled when incorporated into the engine. As detachable, fluid-tight engine parts, such casing covers must possess numerous features while fulfilling specific capacities.

To produce a detachable connection, casing covers must be easy to mount and position, on the one hand, and comprise as few individual parts as possible, on the other hand.

The seal in a casing cover must possess specific properties including consistent shape, i.e., little relaxation, the ability to be reused many times, and a high resistance to fluids in the engine and environmental influences.

To counteract seal relaxation, European Patent Application No. EP 0 664 388 A1 proposes a generic casing cover as a valve cover for a cylinder head of an internal-combustion engine, in which the use of a metallic spring body allows the prestressing force on the seal to be adjusted. In this case, the seal at the cover edge is pressed against the engine block under a certain force during tightening. Through the use of the metallic spring body, the valve cover is in a position to follow the relaxation of the seal.

A drawback of this type of casing-cover design is that, while the force on the seal can be maintained at a relatively constant level, there is no countermeasure for a shifting movement of the cover edges over the sealing surface. Shifting movements of the cover edge may result from, for example, fatigue of the casing-cover material or excessive tightening moments of the cover screws. This is particularly the case when the casing-cover materials are insufficiently stable, the components cannot be constructed to be adequately rigid, or the screw arrangement is unfavorable. Moreover, the seal may be damaged by the shifting movement, or the sealing forces on the elastomer seal material may no longer suffice to prevent leaks.

SUMMARY OF THE INVENTION

It in therefore the object of the invention to develop a casing cover that counteracts the shifting movements of the cover edge, and contains an assembly aid.

This object is accomplished according to the present invention by a casing cover for an internal-combustion engine, particularly valve covers or oil pans, to be mounted detachably and fluid-tight to the engine block, with the cover having a peripheral edge that is profiled to receive an elastomer seal and has an edge surface for engaging a sealing surface of an engine block. An axial extension is disposed at an inner portion of the edge surface of the casing cover and is oriented in the direction of an engine block, with the extension projecting axially beyond the edge surface of the casing cover and being positioned so that the extension will extend beyond the sealing surface on the engine block when installed and at least correctly position the casing cover on an engine block. Advantageous modifications of the invention are discussed.

The concept underlying the invention overcomes the aforementioned technical drawbacks by providing an axial extension on the inside of the edge of the casing cover, with the extension being oriented in the direction of the engine block and projecting axially beyond the sealing surface between the cover and the engine block, so the casing cover is at least positioned correctly.

The axial extension of the casing cover in accordance with the invention effectively prevents shifting movements of the covet edge. Instead, it is possible to manipulate the position of the cover on the sealing surface of the engine block. This purposeful positioning offers the advantage that the sealing surface on the engine block can be adapted exactly to the shape of the elastomer zeal material. This leads in turn to material savings with respect to the sealing surfaces which positively influences the engine weight.

A further advantage is that the extension of the casing cover permits a purposeful, defined introduction of force into the elastomer sealing material, so the occurring tensions can be calculated and adjusted more reliably.

In addition to these advantages, the extension serves as a joining aid in the assembly process, and aids in positioning casing cover during the mounting process. If, in accordance with the invention, the extension is formed such that it fixedly clamps the casing cover to the engine block during the joining process, this greatly facilitates overhead assembly, as may be employed for oil pans.

In a patentable embodiment, the extension is disposed around the entire peripheral edge of the cover. Depending on the application and structural conditions, the extension can also only be formed along part of the cover edge. The advantage of the partial embodiment is a lower weight. However, the all-around embodiment offers more reliable guidance.

The extension projects beyond the sealing surface, in the direction of the engine block, and, in accordance with the invention, is shaped to engage an undercut in the inner wall of the engine block.

According to the invention, partial and all-around undercut engaging shapes are both conceivable. In fact, any undercut shape is conceivable, provided that the casing cover is detachable and is formed to be detached without damaging the extension. For example, rounded areas at the ends of the extension facilitate the joining of the casing cover to the engine block.

In a further embodiment of the invention, it is proposed to form the undercut engaging portion of the extension in the shape of a sloped portion. The slope begins at the inside of the casing cover and extends in the direction of the outside of the cover and toward the inner wall of an engine block. The undercut engaging shape in the form of a slope offers the advantage that, in the event that the cover edge is shifted, the casing cover is drawn in the direction of the sealing surface, which simultaneously increases the sealing force. This advantageous affect can be utilized to influence the relationship between the shifting movement and the buildup of sealing forces. The undercut engaging shape in the form of a slope further offers the option of exerting a prestress on the seal of the casing cover, thereby effecting a very precise positioning in the joining phase, which can in turn be beneficial for automated mounting procedures.

The arrangement of a further slope at the axial lower end of the extension of the cover edge, with the further slope being oriented in the opposite direction of the first slope, centers the casing cover in the joining phase. This greatly facilitates the handling of the casing cover in automated assembly processes.

Depending on the established dimensional tolerance, an additional sealing function can be realized through the production of the extension of the cover edge. This would be of great advantage if, for example, the fastening screws were inadequately tightened, giving rise to the risk of leakage.

In accordance with the invention, a structural adaptation between the sealing surface on the engine block and the extension of the casing cover can also simplify the joining of the casing cover. Thus, it is conceivable to provide a chamfer on the engine block to allow the extension of the cover to latch into the engine block.

The casing cover can comprise arbitrary materials, but, in accordance with the invention, it is preferably produced from a plastic. The extension according to the invention avoids the relaxation occurring in plastics, and the associated shifting movements of the seals on the sealing surface.

Exemplary embodiments of casing covers according to the invention are described in greater detail below, in conjunction with drawings and in the ensuing description.

DESCRIPTION OF THE PREFERRED EMBODIMENTS

Figure 1:
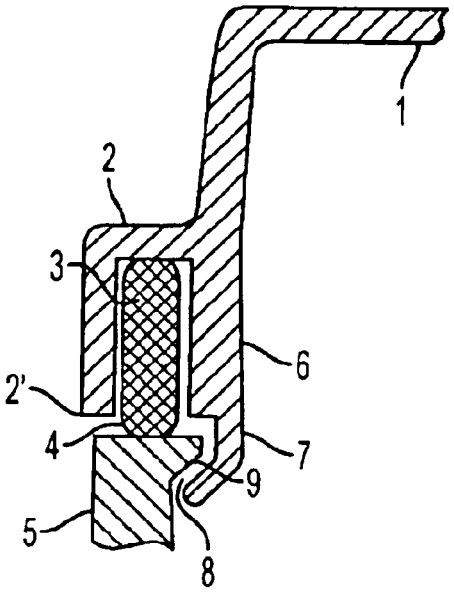
FIG. 1 is a partial cross-sectional view of an embodiment of a casing cover according to the invention, having an undercut engaging shape in the form of a slope.

FIG. 1 is a partial section through a casing cover 1 according to the invention. The casing cover 1 comprises a peripheral cover edge 2 that is profiled to receive an elastomer seal 3, with the seal 2 resting on the sealing surface 4 of the engine block 5 when assembled. On the inner portion 6 of the cover edge, the casing cover 1 has an extension 7, which projects beyond the end surface 2' of the edge 2, and thus beyond the sealing surface 4 in the assembled position. The extension 7 preferably is formed integral with the cover 1 and so as to engage an undercut 8 relative to, i.e., formed in, the engine block 5. In this embodiment, the undercut 8 is shown in the form of a slope 9, so that the end of the extension 7 slopes toward the inner wall of the engine block 5.

Figure 2:
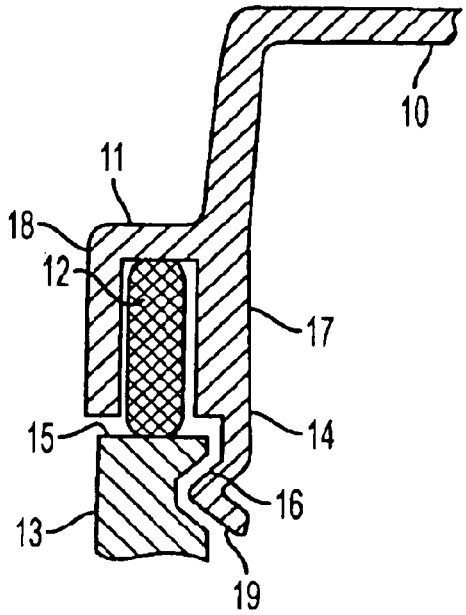
FIG. 2 is a partial cross-sectional view of a further embodiment of a casing cover according to the invention, having an undercut engaging shape in the form of a slope, with a further slope, which is formed in the opposite direction of the first slope, being provided on the extension.

FIG. 2 is a section through a casing cover 10 having a cover edge 11, an elastomer seal 12 and an engine block 13. In this embodiment, the extension 14 at the cover edge 11 projects beyond the end surface of the cover and thus the sealing surface 15, and has a sloped portion 16, which extends from the inside wall 17 of the casing cover 10 toward the outer wall 18; i.e., toward the inner wall of the engine block 5. A further sloped portion 19, which is oriented in the opposite direction from the first sloped portion 16, i.e., in a direction toward the inner wall of the block 5, is disposed on the end of the extension 14, so the further slope 19 can nerve in the joining process.

Figure 3:
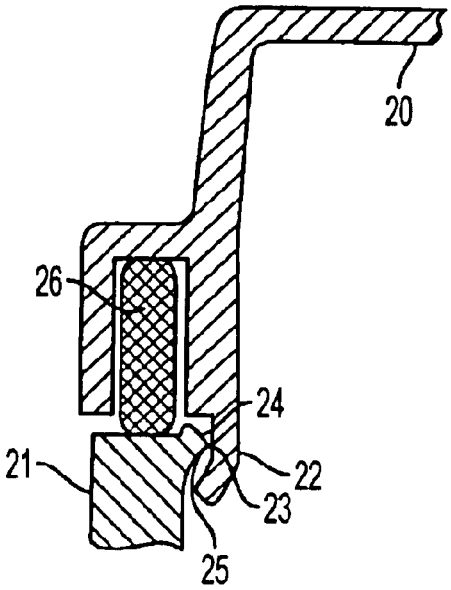
FIG. 3 is a partial cross-sectional view of another embodiment of a casing cover according to the invention, having an undercut engaging in the form of a slope, with a structural leveled region being provided on the engine block between the engine block and the extension.

FIG. 3 is a section through a casing cover 20 according to the invention, in which the engine block 21 can be adapted accordingly to the extension 22. The interior edge of the engine block 21 is provided with a chamfer 23 that facilitates the joining of the casing cover 20. The chamfer 23 has a slope 24 in the direction of the casing cover 20 for joining the casing cover, and a slope 25 in the direction of the engine block 21 for disassembling the casing cover. The chamfer 23 can also serve in limiting the deformation of the elastomer seal 26, and be embodied correspondingly (i.e., round) in the direction of the elastomer seal 26.

The invention now being fully described, it will be apparent to one of ordinary skill in the art that many changes and modifications can be made thereto without departing from the spirit or scope of the invention as set forth herein.

What is claimed is:

1. A casing cover for an internal-combustion engine to be mounted detachably and fluid-tight to an engine block, said cover having: a peripheral edge that is profiled to receive an elastomer seal and has an edge surface for engaging a sealing surface of the engine block; an axial extension disposed at an inner portion of the edge surface of the casing cover and oriented in the direction of the engine block, with the extension projecting axially beyond the edge surface of the casing cover and being positioned so that the extension will extend beyond the sealing surface on the engine block when installed and at least correctly position the casing cover on the engine block.

2. The casing cover according to claim 1, wherein the extension is formed along and is an integral part of the peripheral edge of the casing cover.

3. The casing cover according to claim 1, wherein the extension is formed around the entire peripheral edge of the casing cover.

4. The casing cover according to claim 1, wherein the extension is formed such that casing cover, when disposed on the engine block is centered and clamped on the engine block.

5. The casing cover according to claim 1, wherein the extension is formed with an end portion that will engage an undercut formed in an inner wall of the engine block.

6. The casing cover according to one of claim 5, wherein the end portion of the extension is formed with an undercut engaging shape in the form of a slope.

7. The casing cover according to claim 5, wherein the end portion of the extension is formed with an undercut engaging shape in the form of a first sloped portion extending toward the outside of the cover followed by a second sloped portion at an axial, lower end of the extension end, which second sloped portion is oriented in the opposite direction of the first sloped portion.

8. The casing cover according to claim 1, wherein the casing-cover material is plastic.

9. The casing cover according to claim 1, wherein the cover is a valve cover.

10. The casing cover according to claim 1, wherein the cover is an oil pan.

* * * * *